US008366846B2

(12) United States Patent
Takaki et al.

(10) Patent No.: US 8,366,846 B2
(45) Date of Patent: Feb. 5, 2013

(54) ALUMINUM ALLOY SHEET WITH EXCELLENT POST-FABRICATION SURFACE QUALITIES AND METHOD OF MANUFACTURING SAME

(75) Inventors: Yasuo Takaki, Moka (JP); Takeo Sakurai, Moka (JP); Kwangjin Lee, Moka (JP)

(73) Assignee: Kobe Steel, Ltd., Kobe-shi (JP)

( * ) Notice: Subject to any disclaimer, the term of this patent is extended or adjusted under 35 U.S.C. 154(b) by 310 days.

(21) Appl. No.: 12/934,321

(22) PCT Filed: Mar. 26, 2009

(86) PCT No.: PCT/JP2009/056116

§ 371 (c)(1),
(2), (4) Date: Sep. 24, 2010

(87) PCT Pub. No.: WO2009/123011

PCT Pub. Date: Oct. 8, 2009

(65) Prior Publication Data

US 2011/0017370 A1 Jan. 27, 2011

(30) Foreign Application Priority Data

Mar. 31, 2008 (JP) ..... 2008-092890

(51) Int. Cl.
*C22F 1/05* (2006.01)
*C22C 21/08* (2006.01)

(52) U.S. Cl. ..... 148/697; 148/688; 148/695; 148/696; 148/698; 148/699; 148/700; 148/702; 148/415; 148/416; 148/417; 148/437; 148/438; 148/439; 148/440; 420/528; 420/529; 420/533; 420/534

(58) Field of Classification Search ..... 420/528–529, 420/533–534, 537, 542, 548; 148/688–702, 148/415–417, 437–440
See application file for complete search history.

(56) References Cited

U.S. PATENT DOCUMENTS

| | | | |
|---|---|---|---|
| 6,231,809 | B1 | 5/2001 | Matsumoto et al. |
| 2004/0187985 | A1 | 9/2004 | Matsumoto et al. |
| 2008/0175747 | A1 | 7/2008 | Kajihara et al. |
| 2009/0242088 | A1 | 10/2009 | Takaki et al. |

FOREIGN PATENT DOCUMENTS

| | | |
|---|---|---|
| JP | 8 232052 | 9/1996 |
| JP | 2823797 | 9/1998 |
| JP | 11 189836 | 7/1999 |
| JP | 11 236639 | 8/1999 |
| JP | 2000 96175 | 4/2000 |
| JP | 2003 171726 | 6/2003 |
| JP | 2004 238657 | 8/2004 |
| JP | 2004 292899 | 10/2004 |
| JP | 2005 146310 | 6/2005 |
| JP | 2005 240113 | 9/2005 |
| JP | 2007 247000 | 9/2007 |
| JP | 2008 45192 | 2/2008 |
| JP | 2008 174797 | 7/2008 |

OTHER PUBLICATIONS

Muramatsu, T., "Application and Production Technology of AL—Mg—Si-Alloys—Sheets", Journal of Japan Institute of Light Metals, vol. 53, No. 11 pp. 490-495, (Nov. 30, 2003).

*Primary Examiner* — Lois Zheng
(74) *Attorney, Agent, or Firm* — Oblon, Spivak, McClelland, Maier & Neustadt, L.L.P.

(57) ABSTRACT

Disclosed is an Al—Mg—Si aluminum alloy sheet that can prevent ridging marks during press forming and has good reproducibility even with stricter fabricating conditions. In an Al—Mg—Si aluminum alloy sheet of a specific composition, hot rolling is performed on the basis of a set relationship between the rolling start temperature Ts and the rolling finish temperature Tf° C., whereby the relationship of the cube orientation distribution profile in the horizontal direction of the sheet with the cube orientation alone or another crystal orientation distribution profile at various locations in the depth direction of the sheet is made more uniform, suppressing the appearance of ridging marks that develop during sheet press forming.

14 Claims, No Drawings

ALUMINUM ALLOY SHEET WITH EXCELLENT POST-FABRICATION SURFACE QUALITIES AND METHOD OF MANUFACTURING SAME

TECHNICAL FIELD

The present invention relates to an aluminum alloy sheet (aluminum may be hereinafter simply referred to as Al) with excellent surface qualities after a fabrication process such as press forming and a method of manufacturing the same and to an Al—Mg—Si aluminum alloy sheet in which the production of the surface roughness (referred to also as ridging marks or roping) during a process of press-forming the sheet into a panel can be suppressed. An aluminum alloy sheet mentioned in the present invention is a sheet that has undergone refining such as solution/quenching treatment after being rolled, which is a forming raw material sheet before being formed into a panel by press forming or the like.

BACKGROUND ART

A panel made of an Al—Mg—Si aluminum alloy sheet of AA or JIS 6000 series (hereinafter simply referred to as 6000-series) as a raw material has a problem that appearance quality defects such as ridging marks are likely to develop in a surface thereof. The ridging marks are a phenomenon of roughness produced in a sheet surface during deformation such as by press forming due to textures arranged in stripes in the sheet. The phenomenon is troublesome because the ridging marks are produced by press forming even when the grains of the aluminum alloy sheet as the raw material are fine enough not to cause surface roughness. There is also a problem that the ridging marks are relatively unnoticeable immediately after press forming and become noticeable after the panel is advanced as a panel structure, without any modification, to a painting step.

The ridging marks are particularly likely to be produced when press forming conditions become stricter due to an increased size of the panel structure, a complicated shape thereof, a thinned thickness thereof, or the like. There is also the problem that the ridging marks are relatively unnoticeable immediately after press forming and become noticeable after the panel is advanced as the panel structure, without any modification, to the painting step.

When the ridging marks are produced in a panel structure for use as an outside panel (outer) of which a good-looking surface is particularly required, a problem arises that the appearance thereof becomes poor, and the panel structure cannot be used.

As an approach to such a problem of the ridging marks, it has been conventionally known to cool an ingot after homogenizing heat treatment at a temperature of 500° C. or higher, or reheat the ingot after being cooled to room temperature, start hot rolling at a relatively low temperature of 350 to 450° C. or control a compound, and thereby prevent ridging marks in an excess-Si 6000-series aluminum alloy sheet (See Patent Documents 1, 2, 3, and 10).

There have also been proposed various methods in which textures (crystal orientations) in a 6000-series aluminum alloy sheet are controlled to improve ridging marks. For example, it has been proposed to focus attention on a crystal orientation component of the {100} plane, and reduce the degree of integration of Cube orientation in a sheet surface layer by 2 to 5, and reduce a grain size in a sheet surface portion to 45 μm or less (see Patent Document 4). It has also been proposed to simultaneously regulate the distribution densities of various orientations such as, e.g., Cube orientation, Goss orientation, Brass orientation, CR orientation, RW orientation, S orientation, and PP orientation in a 6000-series aluminum alloy sheet (see Patent Documents 5 and 9).

It has been further proposed to set the ratio of grain boundaries in which the difference between adjacent crystal orientations is 15° or less to 20% or more (see Patent Document 6). In addition, it has also been proposed to set an earing rate in a 6000-series aluminum alloy sheet to 4% or more, and set a grain size therein to 45 μm or less (see Patent Document 7). It has also been proposed to provide, in an aluminum alloy containing Mg, a specified relationship between the area ratio of grains of which the plane orientation in a surface of the alloy is within a range of 10° from the (100) plane and an area ratio of grains of which the plane orientation in the surface of the alloy is within a range of 20% from the (100) plane (see Patent Document 8).

Patent Document 1: Japanese Patent No. 2823797

Patent Document 2: Japanese Unexamined Patent Application Publication No. Hei 08-232052

Patent Document 3: Japanese Unexamined Patent Application Publication No. Hei 07-228956

Patent Document 4: Japanese Unexamined Patent Application Publication No. Hei 11-189836

Patent Document 5: Japanese Unexamined Patent Application Publication No. Hei 11-236639

Patent Document 6: Japanese Unexamined Patent Application Publication No. 2003-171726

Patent Document 7: Japanese Unexamined Patent Application Publication No. 2000-96175

Patent Document 8: Japanese Unexamined Patent Application Publication No. 2005-146310

Patent Document 9: Japanese Unexamined Patent Application Publication No. 2004-292899

Patent Document 10: Japanese Unexamined Patent Application Publication No. 2005-240113

DISCLOSURE OF THE INVENTION

Problems to be Solved by the Invention

The prior-art technologies described above including the control of the textures or properties of the sheets as proposed in Patent Documents 4 to 9 mentioned above have given effects in preventing the ridging marks. However, when forming conditions become stricter such as when an aluminum alloy sheet is formed into a panel having a deeper or more complicated three-dimensional shape, and an amount of sheet thickness reduction due to the forming exceeds 10%, the effects are still insufficient. Moreover, the regulation of the manufacturing method thereof is loose and broad in range, and properties that can reliably prevent a texture or ridging marks to be regulated are not necessarily obtained.

In addition, when cooling to a low hot-rolling starting temperature is performed after the homogenizing heat treatment in Patent Document 1 or 2 described above or the like, if the rate of cooling is low, a Mg—Si compound is precipitated and coarsened so that solution/quenching treatment needs to be performed at a higher temperature for a longer period. This results in the problem of significantly reducing productivity. In recent years, in terms of production efficiency, an ingot has been increased to a size of, e.g., 500 mmt or more. As the larger-size ingot is rapidly cooled to the hot-rolling starting temperature after the homogenizing heat treatment, it is accordingly extremely difficult to stably control the cooling rate and the hot-rolling starting temperature partly due to constraints on actual manufacturing equipment or manufacturing steps. Therefore, in actual manufacturing steps, when cooling to the low hot-rolling starting temperature is performed after the homogenizing heat treatment, the cooling rate is inevitably low. As a result, in reality, the mere starting of hot rolling at the relatively low temperature mentioned above results in unstable material properties of finished products or reduced productivity during solution/quenching treatment, and it is hard to say that the mere starting of hot rolling at the relatively low temperature mentioned above is an effective method for preventing ridging marks.

The present invention has been achieved in view of such circumstances, and an object of the present invention is to provide an Al—Mg—Si aluminum alloy sheet with excellent post-fabrication surface qualities in which ridging marks during press forming, the production of which becomes noticeable when forming conditions become stricter, can be prevented with high reproducibility and a method of manufacturing the same.

Means for Solving the Problems

To attain the object, a first gist of an aluminum alloy sheet with excellent post-fabrication surface qualities according to the present invention is that, in an Al—Mg—Si aluminum alloy sheet containing, in mass %, Mg: 0.4 to 1.0%, Si: 0.4 to 1.5%, Mn: 0.01 to 0.5%, and Cu: 0.001% to 1.0%, with the remainder including Al and inevitable impurities, when an average area ratio of Cube orientation, which is a texture in a surface of the alloy sheet, in a rectangular region of 500 μm in an arbitrary rolling widthwise direction×2000 μm in an arbitrary rolling lengthwise direction is W, the respective Cube orientation average area ratios in ten rectangular regions each having the same area and successively adjacent to each other in the rolling widthwise direction in the rectangular region are W1 to W10, the minimum Cube orientation average area ratio among the Cube orientation average area ratios W1 to W10 is Wmin, and the maximum Cube orientation average area ratio among the Cube orientation average area ratios W1 to W10 is Wmax, the minimum Cube orientation average area ratio Wmin is set to 2% or more, and a difference Wmax−Wmin between the maximum Cube orientation average area ratio Wmax and the minimum Cube orientation average area ratio Wmin is set to 10% or less.

To attain the object, a second gist of an aluminum alloy sheet with excellent post-fabrication surface qualities according to the present invention is that, in an Al—Mg—Si aluminum alloy sheet containing, in mass %, Mg: 0.4 to 1.0%, Si: 0.4 to 1.5%, Mn: 0.01 to 0.5%, and Cu: 0.001% to 1.0%, with the remainder including Al and inevitable impurities, when respective average area ratios of Cube orientation, S orientation, and Cu orientation, each of which is a texture in a surface of the alloy sheet, in a rectangular region of 500 μm in an arbitrary rolling widthwise direction×2000 μm in an arbitrary rolling lengthwise direction are W, S, and C, the respective Cube orientation average area ratios, the respective S orientation average area ratios, and the respective Cu orientation average area ratios in ten rectangular regions each having the same area and successively adjacent to each other in the rolling widthwise direction in the rectangular region when a difference A among the respective average area ratios of the individual orientations is determined from an expression W—S—C are W1 to W10, S1 to S10, and C1 to C10, respectively, and respective differences among the respective average area ratios of the individual orientations each determined from the expression are A1 to A10, the minimum Cube orientation average area ratio among the Cube orientation average area ratios W1 to W10 is set to 2% or more, and a difference Amax−Amin between the maximum average area ratio difference Amax and the minimum average area ratio difference Amin among the respective differences A1 to A10 among the respective average area ratios of the individual orientations is set to 10% or less.

To attain the object, a third gist of an aluminum alloy sheet with excellent post-fabrication surface qualities according to the present invention is that, in an Al—Mg—Si aluminum alloy sheet containing, in mass %, Mg: 0.4 to 1.0%, Si: 0.4 to 1.5%, Mn: 0.01 to 0.5%, and Cu: 0.001% to 1.0%, with the remainder including Al and inevitable impurities, when respective average area ratios of Cube orientation, S orientation, and Cu orientation, each of which is a texture in a portion of the alloy sheet at a depth corresponding to ¼ of a sheet thickness from a surface of the alloy sheet, in a rectangular region of 500 μm in an arbitrary rolling widthwise direction× 2000 μm in an arbitrary rolling lengthwise direction are W, S, and C, the respective Cube orientation average area ratios, the respective S orientation average area ratios, and the respective Cu orientation average area ratios in ten rectangular regions each having the same area and successively adjacent to each other in the rolling widthwise direction in the rectangular region when a difference A among the respective average area ratios of the individual orientations is determined from an expression W—S—C are W1 to W10, S1 to S10, and C1 to C10, respectively, and respective differences among the respective average area ratios of the individual orientations each determined from the expression are A1 to A10, the minimum Cube orientation average area ratio among the Cube orientation average area ratios W1 to W10 is set to 2% or more, and a difference Amax−Amin between the maximum average area ratio difference Amax and the minimum average area ratio difference Amin among the respective differences A1 to A10 among the respective average area ratios of the individual orientations is set to 10% or less.

To attain the object, a fourth gist of an aluminum alloy sheet with excellent post-fabrication surface qualities according to the present invention is that, in an Al—Mg—Si aluminum alloy sheet containing, in mass %, Mg: 0.4 to 1.0%, Si: 0.4 to 1.5%, Mn: 0.01 to 0.5%, and Cu: 0.001% to 1.0%, with the remainder including Al and inevitable impurities, when respective average area ratios of Cube orientation and Goss orientation, each of which is a texture in a portion of the alloy sheet at a depth corresponding to ½ of a sheet thickness from a surface of the alloy sheet, in a rectangular region of 500 μm in an arbitrary rolling widthwise direction×2000 μm in an arbitrary rolling lengthwise direction are W and G, the respective Cube orientation average area ratios and the respective Goss orientation average area ratios in ten rectangular regions each having the same area and successively adjacent to each other in the rolling widthwise direction in the rectangular region when a difference B between the respective average area ratios of the individual orientations is determined from an expression W-G are W1 to W10 and G1 to G10, respectively, and respective differences between the respective average area ratios of the individual orientations each determined from the expression are B1 to B10, the minimum Cube orientation average area ratio among the Cube orientation average area ratios W1 to W10 is set to 2% or more, and a difference Bmax−Bmin between the maximum average area ratio difference Bmax and the minimum average area ratio difference Bmin among the respective differences B1 to B10 between the respective average area ratios of the individual orientations is set to 10% or less.

Here, the maximum Goss orientation average area ratio Gmax among the Goss orientation average area ratios G1 to G10 in the portion of the aluminum alloy sheet at the depth corresponding to ½ of the sheet thickness from the surface of the aluminum alloy sheet is preferably set to 10 or less. Also, the maximum Cube orientation average area ratio Wmax among the Cube orientation average area ratios W1 to W10 in the surface of the aluminum alloy sheet, in the portion of the aluminum alloy sheet at the depth corresponding to ¼ of the sheet thickness from the surface of the aluminum alloy sheet, or in the portion of the aluminum alloy sheet at the depth corresponding to ½ of the sheet thickness from the surface of the aluminum alloy sheet is preferably set to 20% or less.

The aluminum alloy sheet described above is allowed to further contain one of or two or more of Fe: 1.0% or less, Cr: 0.3% or less, Zr: 0.3% or less, V: 0.3% or less, Ti: 0.1% or less, Ag: 0.2% or less, and Zn: 1.0% or less (wherein each of the regulated upper limits thereof does not include 0%).

The gist of a method of manufacturing the aluminum alloy sheet with excellent post-fabrication surface qualities according to the present invention is that, when an ingot of an Al—Mg—Si aluminum alloy having a composition of any of the aluminum alloy sheets described above is subjected to homogenizing heat treatment, and then subjected to hot rolling, the hot rolling is performed such that a hot rolling starting temperature Ts is set in a range of 340 to 580° C. while a hot-rolling ending temperature Tf° C. satisfies a relational expression: $0.08\times Ts+320 \geqq Tf \geqq 0.25Ts+190$ with respect to the hot-rolling starting temperature Ts and, after cold rolling of the hot-rolled sheet is performed, the cold-rolled sheet is subjected to solution/quenching treatment to provide any of the textures described above.

Effects of the Invention

When press forming conditions become stricter such as when the 6000-series aluminum alloy sheet is formed into a panel having a deeper or more complicated three-dimensional shape, and the amount of sheet thickness reduction due to the press forming exceeds 10%, the production of ridging marks becomes noticeable, and the lengths thereof in the rolling widthwise direction (sheet width direction) have a relative large period. That is, the phenomenon in which the ridging marks appear as striped roughness along a rolling direction in the surface of the sheet after subjected to the forming remains the same, but the width of the striped roughness in the rolling widthwise direction (sheet width direction) has a relatively long period of about 2 to 3 mm.

The effect of preventing such ridging marks achieved by the control of a quantitative ratio of each specified crystal orientation, such as the control of the texture of the conventional 6000-series aluminum alloy sheet described above, is still insufficient even when the number of crystal orientations regulated thereby is small or large.

The present inventors have found that the ridging marks having such a relatively large period depend on the distribution state of a specified crystal orientation in the sheet width direction (rolling widthwise direction) at each of the depth locations (locations in the depth direction of the sheet) in the sheet thickness direction, though the ridging marks are the same textures. That is, such ridging marks are greatly influenced by the distribution state of a specified crystal orientation in the relatively wide region of the sheet, such as the deviation in a specified crystal orientation present in the rolling widthwise direction or thickness direction of the aluminum alloy sheet or the deviation between individual specified crystal orientations each present in the rolling widthwise direction or thickness direction of the aluminum alloy sheet.

When the texture is analyzed and evaluated with the prior-art technology for controlling the texture of the sheet described in Patent Documents shown above, evaluation can be performed only in an extremely narrow region of the sheet. For example, in Patent Document 9, the texture in each of the cross sections of the sheet when the width of the sheet is divided into 500 μm regular intervals in the region measuring 3 mm in the sheet width direction is measured. However, this indicates that evaluation corresponding to at most one period of the riding marks having the large period described above has only been achieved. Moreover, since the ridging marks are the textures in cross sections perpendicular to the rolling direction over the entire sheet thickness, the influence of deviations or variations depending on sheet thickness locations has not been evaluated, either. That is, in the prior-art technology for controlling the texture of the sheet described in each of Patent Documents shown above, consideration has not been given to the riding marks the production of which becomes noticeable when press forming conditions become stricter and the lengths of which in the sheet width direction have a relatively large period of about 2 to 3 mm, including variations in the surface roughness thereof.

This may be one presumable cause of the effect of preventing the ridging marks which is still insufficient even with the conventional control of the texture of the 6000-series aluminum alloy sheet. However, it is to be noted that, in the present invention also, the mechanism of ridging mark production in which the amount of strain introduced in adjacent grains (amount of deformation in crystal plasticity) is different if the crystal orientation of the sheet is different, and ridging marks which are variations in surface roughness are likely to develop and the recognition of the mechanism are the same as in Patent Documents described above in which crystal orientations are regulated.

However, the present invention is greatly different in the first place in that the state of the texture in the relatively wide region of the Al—Mg—Si aluminum alloy sheet corresponding to the period of the ridging marks is regulated by considering the magnitude of the period of the ridging marks or variations therein described above to allow the sheet to be formed into a shape the forming conditions of which are stricter than conventionally so that an amount of sheet thickness reduction due to press forming exceeds 10%.

In the present invention, as a texture in such a wide region of the Al—Mg—Si aluminum alloy sheet in the sheet width direction, Cube orientation is particularly selected in each of the surface of the sheet and the portions at depths corresponding to ¼ and ½ of the sheet thickness from the surface such that the distribution state thereof is to be controlled. In each of the surface of the sheet and the portion thereof at the depth corresponding to ¼ of the sheet thickness from the surface, S orientation and Cu orientation are selected in addition to Cube orientation such that the distribution states thereof are to be controlled. In the portion at the depth corresponding to ½ of the sheet thickness from the surface, Goss orientation is further selected in addition to Cube orientation such that the distribution state thereof is to be controlled.

That is, in the vicinity of the portion at the depth corresponding to ¼ of the sheet thickness from the sheet surface layer, whether ridging marks are produced or not is determined by the independent distribution state of Cube orientation or by the respective distribution states of Cube orientation, S orientation, and Cu orientation. On the other hand, in the vicinity of the portion corresponding to ½ of the sheet thickness, whether ridging marks are produced or not is determined by the respective distribution states of Cube orientation and Goss orientation.

Thus, the present invention provides the Al—Mg—Si aluminum alloy sheet with the texture in which the distribution state of each of these representative crystal orientations or the respective distribution states of these representative crystal orientations in each of the sheet thickness regions are as uniform as possible in the sheet width direction. As a result, it is possible to provide the Al—Mg—Si aluminum alloy sheet in which the production of the ridging marks having the relatively large period can be inhibited, which becomes noticeable when forming conditions become stricter such as when the sheet is formed into a panel having a deeper or more complicated three-dimensional shape.

BEST MODE FOR CARRYING OUT THE INVENTION

A specific description will be given below of embodiments of an aluminum alloy sheet according to the present invention.

(Texture)

As is generally known, Cube orientation is a main orientation of a recrystallized texture of aluminum, and is also one of principal orientations in an Al—Mg—Si alloy sheet. As the other principal orientation components of the recrystallized texture, S orientation, Cu orientation, Goss orientation, and the like are formed. Depending on these crystal orientations, even when equal stretching is performed additionally, there are different states of deformation.

When a sheet with Cube orientation is stretched in a direction at 45° to the rolling direction, significant shrinkage deformation in a sheet thickness direction occurs, while shrinkage deformation barely occurs in a direction (referred to also as a sheet width direction) perpendicular to a tensile axis direction and parallel with a sheet surface. On the other hand, shrinkage deformation in the sheet thickness direction is small in a sheet with S orientation, Cu orientation, or Goss orientation. By contrast, in a sheet with Goss orientation, shrinkage deformation in the sheet width direction becomes dominant when the sheet is stretched in the rolling widthwise direction, while shrinkage deformation in the sheet thickness direction barely occurs, so that shrinkage deformation in the sheet thickness direction is extremely small compared with shrinkage deformation in the sheet thickness direction in the sheet with any of the other orientations.

Accordingly, if Cube orientation or Goss orientation having properties significantly different from those of the other orientations exists in a large quantity and forms a cluster, when a forming process of stretching a sheet in a direction at 45° to the rolling direction or in a direction perpendicular to the rolling direction is performed additionally, an amount of shrinkage deformation in the sheet thickness direction differs depending on the quantity of Cube orientation or Goss orientation and on the stretching direction so that roughness is likely to be produced in the sheet surface. To inhibit the production of roughness in the sheet surface, i.e., ridging marks, the prior-art technologies have proposed a method which regulates the degree of integration thereof or regulates manufacturing conditions so as not to develop a clustered texture.

However, even when Cube orientation or Goss orientation is relatively small in quantity, and does not form a noticeable cluster, when the distribution state thereof differs depending on a location in the rolling widthwise direction of the sheet, the behavior of shrinkage deformation in the sheet thickness direction when the entire sheet is equally stretched differs depending on the location. If not only the independent distribution state of Cube orientation or Goss orientation, but also the combined distribution states of Cube orientation, S orientation, Cu orientation, and Goss orientation similarly differ depending on a location in the rolling widthwise direction, the behavior of shrinkage deformation in the sheet thickness direction when the entire sheet is equally stretched differs depending on the location.

A value obtained by adding up the shrinkage deformation in the sheet thickness direction over the entire thickness of the sheet corresponds to a sheet thickness direction. Accordingly, even in portions each at a ½ depth from the sheet surface, if shrinkage deformation in the sheet thickness direction differs from location to location, the sheet thickness reduction differs so that roughness is produced in the sheet surface.

If a local quantity of Cube orientation or Goss orientation present in the sheet surface and/or at a ¼ depth from the sheet surface or a ½ depth from the sheet surface is extremely large, when the entire sheet is equally stretched, the amounts of shrinkage in the sheet width direction at the individual sheet thickness locations are significantly different so that local warping or curving of the sheet occurs. In this case also, roughness is produced in the sheet surface.

When the distribution state of Cube orientation and/or the combined distribution states of Cube orientation, S orientation, Cu orientation, and Goss orientation thus differ, when the sheet is press-formed, roughness is naturally produced in the sheet surface depending on a location in the sheet, and ridging marks and surface roughness are produced. In particular, in the case where the orientation distribution has a wide-range period in the sheet width direction, even if the ridging marks are unnoticeable when the sheet is press-formed into a conventional shape with a relatively small amount of strain, the ridging marks become noticeable when the forming conditions for the sheet shown above become stricter and the amount of strain exceeds 10%, resulting in a surface defect.

Accordingly, in the present invention, the distribution state of Cube orientation and/or the combined distribution states of Cube orientation, S orientation, Cu orientation, and Goss orientation in the wide region in the sheet width direction described above are made as uniform as possible. In other words, the deviation between each of the orientations present in the relatively wide region of the sheet described above and each of the other crystal orientations having different properties is minimized.

(Definition of Relatively Wide Region of Sheet)

Here, in the present invention, to prevent or inhibit the ridging marks having the relatively large period from being produced under stricter press forming conditions, the crystal orientation distribution state in the wide region in the sheet width direction is made as uniform as possible, as described above. For this purpose, it is also necessary for a region where a texture is measured or regulated to be a relatively wide region in the sheet width direction in correspondence thereto.

As will be described later, in X-ray diffraction used generally for the measurement of a texture, an average existence ratio of each of the crystal orientations in the entire measurement region is measured. As a result, the distribution state in, e.g., the sheet width direction cannot be precisely reflected in the measurement result. By contrast, in a crystal orientation analyzing method using EBSP, a measurement range covers a macro region, and therefore the crystal orientation distribution state in the wide region in the sheet width direction therein can be precisely reflected in the measurement result.

Thus, the present invention measures and regulates the texture by the crystal orientation analyzing method using EBSP, and widens the measurement region to allow the crystal orientation distribution state in the wide region in the sheet width direction to be precisely reflected or serve as a representative. That is, a relatively wide rectangular region in the sheet width direction (rolling widthwise direction) at each of depth locations in the sheet thickness direction is defined for regulating the texture. Specifically, the rectangular region is defined at each of the depth locations in the sheet thickness direction in accordance with a specified crystal orientation, i.e., in the sheet surface, in the portion of the sheet at a depth corresponding to ¼ of the sheet thickness from the sheet surface, and in the portion of the sheet at a depth corresponding to ½ of the sheet thickness from the sheet surface, and the defined areas (sizes) of the individual rectangular regions are equalized. Then, each one of the rectangular regions is regulated to have a size of 500 μm in an arbitrary rolling widthwise direction×2000 μm in an arbitrary rolling lengthwise direction. In the present invention, ten of the rectangular regions of the same areas are successively arranged in mutually adjacent relation in the rolling widthwise direction (sheet width direction) of the sheet, and the average area of each specified crystal orientation in the total of ten rectangular regions, which is the texture in each of the rectangular regions, is regulated.

(Texture in Sheet Surface: Area Ratio of Cube Orientation)

In an Al—Mg—Si alloy sheet manufactured by rolling and solution/quenching treatment, Cube orientation may be intensely integrated particularly in a sheet surface depending on manufacturing conditions. In such a case, ridging marks may be produced only by the distribution of Cube orientation, not by another crystal orientation component. Therefore, in the present invention, based on the technical idea described above, the distribution state of Cube orientation in the sheet width direction defined by the rectangular regions described above is first made as uniform as possible in the sheet surface. That is, in the texture in the surface of the Al—Mg—Si aluminum alloy sheet in which Cube orientation exists in a largest quantity, the distribution state of Cube orientation in the sheet width direction defined by the rectangular regions described above is regulated to be as uniform as possible.

Specifically, it is assumed that a minimum Cube orientation average area ratio Wmin in the rectangular regions in the sheet surface is set to 2% or more. If the minimum Cube orientation average area ratio Wmin is less than 2%, the possibility is high that manufacturing conditions are largely deviated from manufacturing conditions for rolling, solution/quenching treatment, and the like regulated or assumed to be desirable in the present invention, or the texture of a sample is not precisely reflected due to improper preparatory treatment of an EBSP measurement sample. In such a case, the crystal orientation distribution regulated in the present invention cannot be obtained at all, or sufficiently precise measurement cannot be performed.

The upper limit of the area ratio of Cube orientation is preferably set to 20% or less as a maximum Cube orientation average area ratio Wmax in the rectangular regions in the sheet surface. When the maximum Cube orientation average area ratio Wmax exceeds 20%, noticeable roughness may be produced solely at a location with the maximum Cube Orientation average area ratio Wmax even if the distribution state of Cube orientation or another crystal orientation satisfies the regulation of the present invention so that ridging marks are likely to be produced.

(Regulation of Distribution State of Cube Orientation in Sheet Surface)

Based on these assumptions, in the present invention, the independent distribution state of Cube orientation in a sheet surface layer is first regulated. As described above, the independent distribution state of Cube orientation is thus regulated when Cube orientation is intensely integrated particularly in the sheet surface, or specifically when the maximum Cube orientation area ratio Wmax in the rectangular regions in the sheet surface exceeds 15%.

The distribution state of Cube orientation in the sheet surface layer is specifically regulated as follows. When it is assumed that the respective Cube orientation average area ratios in the ten rectangular regions in the sheet surface mentioned above are W1 to W10, the minimum Cube orientation average area ratio is Wmin, and the maximum Cube orientation average area ratio is Wmax, the difference Wmax−Wmin between the maximum Cube orientation average area ratio Wmax and the minimum Cube orientation average area ratio Wmin, which is the deviation in the crystal orientation distribution, is reduced to 10% or less.

In this manner, the distribution state of Cube orientation in the sheet width direction in the surface of the Al—Mg—Si aluminum alloy sheet is made as uniform as possible to reduce the variation in the state of deformation in press forming.

As a result, it is possible to prevent or inhibit the production of the ridging marks having the relatively large period mentioned above which becomes noticeable when forming conditions become stricter such as when the aluminum sheet is formed into a panel having a deeper or more complicated three-dimensional shape. On the other hand, if the difference Wmax−Wmin between the maximum Cube orientation average area ratio Wmax and the minimum Cube orientation average area ratio Wmin, which is the deviation in the crystal orientation distribution, exceeds 10%, the deviation in the crystal orientation distribution is excessively large so that the deviation in the state of deformation in press forming increases. As a result, the production of the riding marks having the relatively large period described above cannot be prevented or inhibited.

(Regulation of Distribution States of Cube Orientation, S Orientation, and Cu Orientation in Sheet Surface or in Portion at Depth Corresponding to ¼ of Sheet Thickness from Sheet Surface)

By contrast, depending on manufacturing conditions, the integration of Cube orientation is relatively low, and S orientation and Cu orientation are present in relatively large quantities in the sheet surface of the Al—Mg—Si alloy sheet manufactured by rolling and solution/quenching treatment and in a portion at a depth corresponding to ¼ of the sheet thickness from the sheet surface. The integration of Cube orientation is thus low in the sheet surface and in the portion at the depth corresponding to ¼ of the sheet thickness from the sheet surface when the maximum Cube orientation area ratio Wmax in the rectangular regions described above is 2 to 15%.

In such a case, to prevent or inhibit the production of the ridging marks, it is necessary to make as uniform as possible not only the distribution state of Cube orientation but also the distribution states of Cube orientation, S orientation, and Cu orientation each in the sheet width direction defined by the rectangular regions described above in the sheet surface or in the portion at the depth corresponding to ¼ of the sheet thickness from the sheet surface.

Specifically, when it is assumed that the Cube orientation average area ratio, the S orientation average area ratio, and the Cu orientation average area ratio each in the rectangular regions described above in the sheet surface or in the portion at the depth corresponding to ¼ of the sheet thickness from the sheet surface are W, S, and C, respectively, the difference A among the respective average area ratios of these individual orientations is determined from the expression W—S—C. Then, the average area ratio differences A1 to A10 among Cube orientation average area ratios W1 to W10, S orientation average area ratios S1 to S10, and Cu orientation average area ratios C1 to C10 in the ten rectangular regions described above, which are determined similarly to the foregoing average area ratio difference A from the expression shown above, are determined. Then, the difference Amax−Amin between the maximum average area ratio difference Amax and the minimum average area ratio difference Amin among the average area ratio differences A1 to A10 among the respective average area ratios of the individual orientations is reduced to 10% or less.

In this manner, the crystal orientation distribution states in the sheet width direction when Cube orientation, S orientation, and Cu orientation are simultaneously present in substantial quantities in the surface of the Al—Mg—Si aluminum alloy sheet or in the portion thereof at the depth corresponding to ¼ of the sheet thickness from the sheet surface are made as uniform as possible to reduce the deviation in the state of deformation in press forming. As a result, it is possible to prevent or inhibit the production of the ridging marks having the relatively large period described above which becomes noticeable when the forming conditions shown above become stricter.

It is sufficient for the foregoing regulation of the deviation Amax−Amin among the crystal orientation distributions to be satisfied in at least either of the sheet surface and the portion at the depth corresponding to ¼ of the sheet thickness from the sheet surface. However, when the forming conditions shown above become stricter, it is preferable that the foregoing regulation of the deviation Amax−Amin among the crystal orientation distributions is satisfied in both of the sheet surface and the portion at the depth corresponding to ¼ of the sheet thickness from the sheet surface.

On the other hand, if the deviation Amax−Amin among the crystal orientation distributions exceeds 10% in both of the sheet surface and the portion at the depth corresponding to ¼ of the sheet thickness from the sheet surface, the distribution states of the crystal orientations having different properties in the sheet surface and the portion at the depth corresponding to ¼ of the sheet thickness from the sheet surface become non-uniform in the sheet width direction. In other words, the deviation between each of the crystal orientations present in the relatively wide region of the sheet described above and each of the other crystal orientations having different properties increases. As a result, when the forming conditions shown become stricter, the production of the ridging marks having the relatively large period cannot be prevented or inhibited.

(Regulation of Distribution States of Cube Orientation and Goss Orientation in Portion at Depth corresponding to ½ of Sheet Thickness from Sheet Surface)

Further, in the portion of the Al—Mg—Si alloy sheet manufactured by rolling and solution/quenching treatment at the depth corresponding to ½ of the sheet thickness from the sheet surface, depending on manufacturing conditions, Goss orientation may also be present in a large quantity in addition to Cube orientation. Accordingly, if the area ratio of Goss orientation in the rectangular regions described above in the portion at the depth corresponding to ½ of the sheet thickness from the sheet surface is present in a substantial quantity of, e.g., 0.5% or more, in order to prevent or inhibit the production of the ridging marks, it is necessary to regulate not only the distribution state of Cube orientation but also the relationship between the respective distribution states of Cube orientation and Goss orientation in the portion at the depth corresponding to ½ of the sheet thickness from the sheet surface.

Specifically, when it is assumed that the Cube orientation average area ratio and a Goss orientation average area ratio each in the rectangular regions described above in the portion at the depth corresponding to ½ of the sheet thickness of the sheet surface are W and G, respectively, the difference B % between the respective average area ratios of the individual orientations is determined from the expression W-G. Then, when it is assumed that the respective Cube orientation average area ratios and the respective Goss orientation average area ratios in the ten rectangular regions described above are W1 to W10 and G1 to G10, respectively, the differences B1 to B10 between the respective average area ratios of the individual orientations are each determined from the expression shown above. Then, the difference Bmax−Bmin between the maximum average area ratio difference Bmax and the minimum average area ratio difference Bmin among the respective average area ratio differences B1 to B10 is reduced to 10% or less.

In this manner, the crystal orientation distribution states in the sheet width direction regulated by the rectangular regions described above when Cube orientation and Goss orientation are simultaneously present in substantial quantities in the portion of the Al—Mg—Si aluminum alloy sheet at the depth corresponding to ½ of the sheet thickness from the surface thereof are made as uniform as possible to reduce the deviation in the state of deformation in press forming. As a result, it is possible to prevent or inhibit the production of the riding marks having the relatively large period described above which becomes noticeable when the forming conditions shown above become stricter.

On the other hand, if the deviation Bmax−Bmin between the crystal orientation distributions exceeds 10%, the distribution states of the crystal orientations having different properties in the portion at the depth corresponding to ½ of the sheet thickness from the sheet surface become non-uniform in the sheet width direction. In other words, the deviation between each of the crystal orientations present in the sheet width direction regulated by the rectangular regions described above and each of the other crystal orientations having different properties increases. As a result, when the forming conditions shown above become stricter, the production of the ridging marks having the relatively large period cannot be prevented or inhibited.

Here, it is preferable that the maximum Goss orientation average area ratio Gmax among the Goss orientation average area ratios G1 to G10 described above in the portion at the depth corresponding to ½ of the sheet thickness from the surface of the aluminum alloy sheet described above is set to 10% or less. When the maximum Goss orientation average area ratio Gmax exceeds 10%, noticeable roughness may be produced solely at a location with the maximum Goss orientation average area ratio Gmax even if the distribution states of Goss orientation and Cube orientation satisfy the regulation of the present invention so that the ridging marks are likely to be produced.

(Way to Combine Controls of Distribution States of Crystal Orientations)

In the present invention, control is performed so as to independently satisfy each of: (1) the regulation of the distribution state of Cube orientation in the sheet surface; (2) the regulation of the distribution states of Cube orientation, S orientation, and Cu orientation in the sheet surface; (3) the regulation of the distribution states of Cube orientation, S orientation, and Cu orientation in the portion at the depth corresponding to ¼ of the sheet thickness from the sheet surface; and (4) the regulation of the distribution states of Cube orientation and Goss orientation in the portion at the depth corresponding to ½ of the sheet thickness from the sheet surface that have been described above or satisfy a combination of the controls (1) to (4). A way to combine these controls (1) to (4) is selected appropriately, as described above, in accordance with the state of presence of each of the crystal orientations at each of locations in the thickness direction of the sheet, the state of production of ridging marks to be improved, and the forming conditions shown above, which depend on the component composition and the manufacturing conditions.

(Measurement of Texture in Aluminum Alloy Sheet)

A notation method for crystal orientations differs depending on a fabrication method, even when the crystal orientations belong to the same crystal system. A crystal orientation in a rolled sheet material is represented by a rolled surface and a rolling direction. That is, as shown below, a plane of the crystal orientation parallel with the rolled surface is represented as {hkl}, and an orientation parallel with the rolling direction is represented as <uvw>. Note that each of h, k, l, u, v, and w represents an integer.

Based on such a notation method, each of the orientations is represented as follows. Note that the notation of each of the orientations is described in "Texture" written and edited by Shin-ichi Nagashima (published by Maruzen K. K.), a commentary in Journal of Japan Institute of Light Metals, vol. 43 (1993), pp. 285-293, or the like.

Cube: {001}<100>
Goss: {011}<100>
CR: {001}<520>
RW: {001}<110> [corresponding to Cube orientation turned with respect to the (100) plane]
Brass: {011}<211>
S: {123}<634>
Cu: {112}<111>
SB: {681}<112>

(Measurement of Area Ratio of Each Crystal Orientation)

The area ratio (existence ratio) of each of these crystal orientations of grains, such as Cube, S, Cu, and Goss, is measured by analyzing each of the planes of the sheet described above by a crystal orientation analyzing method (SEM/EBSP method) using a scanning electron microscope (SEM) and an electron backscatter diffraction pattern (EBSP). That is, the rectangular regions described above of each of the planes of the surface of the sheet mentioned above, the portion thereof at the depth corresponding to ¼ of the sheet thickness from the sheet surface, and the portion thereof at the depth corresponding to ½ of the sheet thickness from the sheet surface are measured by the SEM/EBSP method.

In the crystal orientation analyzing method using the EBSP mentioned above, measurement is performed by scanning a specified sample region at arbitrary given intervals, and the process described above is automatically performed with respect to each of measurement points. As a result, when the measurement is ended, crystal orientation data from several tens to several hundreds of thousands of points in a rolling direction and a rolling widthwise direction which are defined by the rectangular regions described above can be obtained. Accordingly, the crystal orientation analyzing method using the EBSP mentioned above is advantageous in that the field of observation is large, and information on the distribution state of numerous grains, the average grain size, the standard deviation of the average crystal gain size, or orientation analysis can be obtained within several hours. Therefore, the crystal orientation analyzing method using the EBSP mentioned above is optimum in the case where the texture in the foregoing wide rectangular regions in the sheet width direction is regulated or measured, and the texture in the sheet width direction defined by the rectangular regions described above is precisely regulated or caused to serve as a representative, as shown in the present invention.

By contrast, in X-ray diffraction (X-ray diffraction intensity or the like) generally used for the measurement of a texture, the average existence ratio of each crystal orientation in the entire measurement region is measured, and information on the distribution state of each of grains in an observation plane cannot be obtained. As a result, the wide-range crystal orientation distribution in the sheet width direction defined by the rectangular regions described above, which influences the ridging marks, cannot be measured as precisely and efficiently as in accordance with the crystal orientation analyzing method using the EBSP mentioned above.

In the crystal orientation analyzing method using the EBSP mentioned above, specimens for texture observation are collected from the planes at the individual thickness positions in the sheet described above, subjected to mechanical polishing and buff polishing, and then subjected to electrolytic polishing for the adjustment of the surface thereof. For each of the specimens thus obtained, it is determined whether or not each grain is in a target orientation (within a range of 15° from an ideal orientation) using, e.g., a SEM (JEOL JSM5410) commercially available from JEOL Ltd. as a SEM device and, e.g., an EBSP measurement/analysis system or an orientation imaging micrograph (OIM) commercially available from TSL Co., which is analysis software under the tradename of "OIM Analysis", to determine an orientation density (area of each crystal orientation) in a measurement field of view.

It is assumed that the regions of the specimens where the average area ratio of each specified crystal orientation is measured are the rectangular regions at each of the depth locations in the sheet thickness direction in accordance with the specified crystal orientation described above. That is, it is assumed that, at each of the depth locations, each of the rectangular regions has a size of 500 μm in an arbitrary rolling widthwise direction×2000 μm in an arbitrary rolling lengthwise direction, and the total of ten rectangular regions each having the same area are successively arranged in mutually adjacent relation in the rolling widthwise direction (sheet width direction) of the sheet. Based on the obtained measurement data, measurement and evaluation are performed with the average area ratio (%) obtained by dividing the sum of the areas of each crystal orientation in these predetermined measurement regions by the total measurement area.

In the crystal orientation analyzing method using the EBSP mentioned above, an electron backscatter diffraction pattern (EBSP referred to also as a pseudo-Kikuchi pattern) generated when the surface of the sample set in the SEM is irradiated with an electron beam is inputted to the measurement/analysis system, and compared with a pattern using a known crystal system, whereby a crystal orientation at the point (measurement point) irradiated with the electron beam is determined.

By scanning each of the ten rectangular regions of the sample as a measurement target with the electron beam at step intervals of, e.g., 5 μm, measuring a crystal orientation at each of the measurement points, and analyzing the measurement result in combination with measurement point locational data, it is possible to measure the crystal orientations of the individual grains or the distribution state of the grains in the measurement regions. In the present invention, as described above, the average area ratio of each crystal orientation is measured and evaluated in each of the ten rectangular regions. However, it is also possible to measure and evaluate the crystal orientation distribution in a wider region or, conversely, in a minute region.

(Chemical Component Composition)

The chemical component composition of the 6000-series aluminum alloy sheet targeted by the present invention will be described below. As a sheet for the outside plate of an automobile mentioned above, the 6000-series aluminum alloy sheet targeted by the present invention is required to have various properties such as excellent formability, bake hardenability, strength, weldability, and corrosion resistance.

To satisfy such requirements, it is assumed that the composition of the aluminum alloy sheet includes, in mass %, Mg: 0.4 to 1.0%, Si: 0.4 to 1.5%, Mn: 0.01 to 0.5% (preferably 0.01 to 0.15%), and Cu: 0.001 to 1.0% (preferably 0.01 to 1.0%), with the remainder including Al and inevitable impurities. Note that the % notation of the content of each of the elements indicates mass %.

The 6000-series aluminum alloy sheet targeted by the present invention is likely to develop ridging marks, but is preferably applied to an excess-Si 6000-series aluminum alloy sheet which has more excellent bake hardenability and in which the mass Si/Mg ratio between Si and Mg is 1 or more. During press forming or bending, the proof stress of the 6000-series aluminum alloy sheet is reduced to ensure formability. Each of 6000-series aluminum alloy sheets is age-hardened by heating during artificial aging treatment at a relatively low temperature such as paint baking treatment for a panel after forming to have improved proof stress and excellent age hardenability (bake hardenability) that can ensure a required strength. Among the 6000-series aluminum alloy sheets, the excess-Si 6000-series aluminum alloy sheet is more excellent in bake hardenability than the 6000-series aluminum alloy sheet in which the mass Si/Mg ratio is less than 1.

The elements other than Mg, Si, Mn, and Cu are basically impurities, and each assumed to be contained in a content (tolerable amount) of each impurity level in accordance with the AA or JIS standards or the like. In terms of recycle, when not only a high-purity Al base metal is used as a material to be molten, but also a 6000-series alloy and other aluminum alloy scraps, a low-purity Al base metal, and the like are used in a large amount as raw materials to be molten, the following other elements may be mixed in as impurities. Since the very reduction of these impurity elements to, e.g., a detection limit or less results in a cost increase, containing these impurities in a certain quantity needs to be tolerated. There is a content range in which impurity elements do not impair the object or effects of the present invention even if contained in a substantial quantity, and there is also an element which achieves an effect when contained in the content range.

Therefore, it is tolerated to contain each of the following elements in a range of not more than an amount regulated below. Specifically, one of or two or more of Fe: 1.0% or less, Cr: 0.3% or less, Ti: 0.1% or less, and Zn: 1.0% or less may also be contained in the range in addition to the fundamental composition shown above. Here, it is assumed that each of the regulated upper limits of these individual elements does not include 0%.

A description will be given hereinbelow of the preferable content range and significance of each of the elements or the tolerable amount thereof in the 6000-series aluminum alloy mentioned above.

Si: 0.4 to 1.5%

Si, along with Mg, is an indispensable element for forming an aged precipitate which contributes to solid solution hardening and to a strength improvement during the artificial aging treatment at the low temperature mentioned above such as the paint baking treatment to exhibit the age hardenability, and providing a strength (proof stress) required of the outer panel of an automobile.

In addition, to exhibit an excellent low-temperature age hardenability in lower-temperature and shorter-period paint baking treatment after the aluminum alloy sheet is formed into the panel, it is preferable to provide a 6000-series aluminum alloy composition in which the Si/Mg mass ratio is set to 1.0 or more and the content of Si with respect to Mg is more excessive than in a typically called excess-Si type.

If the Si content is excessively low, the age hardenability mentioned above and various properties required for various applications, such as press formability, cannot be simultaneously obtained. Moreover, recrystallization is accelerated during hot rolling or after hot rolling is ended so that coarse recrystallized grains are produced, or Cube orientation is likely to develop and the crystal orientation distribution state cannot be controlled to be uniform within the regulated range of the present invention. On the other hand, if the Si content is excessively high, coarse particles and coarse precipitates are produced to significantly impair press formability including bendability. Further, weldability is also significantly impaired. Accordingly, the content of Si is limited to the range of 0.4 to 1.5%.

Mg: 0.4 to 1.0%

Mg is an indispensable element for forming an aged precipitate which contributes to solid solution hardening and contributes, along with Si, to a strength improvement during the artificial aging treatment described above such as the paint baking treatment, exhibiting the age hardenability, and providing the proof stress required of a panel.

If the Mg content is excessively low, an absolute amount is insufficient so that the precipitates described above cannot be formed during the artificial aging treatment, and the age hardenability cannot be exhibited. As a result, the proof stress required of a panel cannot be obtained. Moreover, recrystallization is accelerated by hot rolling so that coarse recrystallized grains are produced, or Cube orientation is likely to develop and the crystal orientation distribution state cannot be controlled to be uniform within the regulated range of the present invention.

On the other hand, if the Mg content is excessively high, an SS mark (stretcher-strain mark) is rather likely to be produced during press forming. Accordingly, the content of Mg is set to an amount within the range of 0.4 to 1.0% such that the Si/Mg mass ratio is 1.0 or more.

Cu: 0.001 to 1.0%

Cu has the effect of accelerating the formation of the aged precipitate which contributes to a strength improvement into the grains of the structure of an aluminum alloy material under the conditions of the relatively low-temperature and short-period artificial aging treatment according to the present invention. In addition, solid-solved Cu also has the effect of improving formability. The effect is not obtained if the Cu content is less than 0.001%, particularly less than 0.01%. On the other hand, if the Cu content exceeds 1.0%, stress corrosion cracking resistance, filiform corrosion resistance included in post-painting corrosion resistance, or weldability is significantly degraded. Accordingly, the Cu content is set to the range of 0.001 to 1.0%, or preferably 0.01 to 1.0%.

Mn: 0.01 to 0.5%

Mn develops dispersed particles (dispersoid phase) during the homogenizing heat treatment, and these dispersed particles have the effect of preventing grain boundary migration after recrystallization so that Mn has the effect of allowing fine grains to be obtained. As described above, the press formability and bendability of the aluminum alloy sheet according to the present invention improve as the grains of the structure of the aluminum alloy are finer. However, these effects are not obtained if the Mn content is less than 0.01%.

On the other hand, when the Mn content has increased, a coarse Al—Fe—Si—Mn compound is likely to be produced to cause the degradation of the mechanical properties of the aluminum alloy sheet. Therefore, if the Mn content exceeds 0.5%, the press formability and bendability are rather degraded. Accordingly, the Mn content is set to a range of 0.01 to 0.5%, or preferably 0.01 to 0.15%.

(Manufacturing Method)

Next, a description will be given of a method of manufacturing the aluminum alloy sheet according to the present invention. The manufacturing process of the aluminum alloy sheet according to the present invention is a normally practiced or known method. The aluminum alloy sheet according to the present invention is manufactured by casting an ingot of an aluminum alloy having the 6000-series component composition shown above, performing homogenizing heat treatment to the ingot, performing hot rolling and cold rolling thereto to provide an aluminum alloy sheet with a predetermined thickness, and further performing refining treatment such as solution/quenching treatment thereto.

However, to control the texture within the range of the present invention during these manufacturing steps for an improved ridging mark property, it is necessary to control hot rolling conditions, as will be described later. In the other steps also, there are preferable conditions for uniformly controlling the crystal orientation distribution state within the regulated range of the present invention.

(Melting/Casting Cooling Rate)

First, in a melting/casting step, a molten metal of an aluminum alloy the melting of which is modified within the 6000-series component composition range shown above is cast by appropriately selecting a typical melting/casting method such as a continuous casting method or a semi-continuous casting method (DC casting method). Here, to effect control for uniformizing the crystal orientation distribution state within the regulated range of the present invention, it is preferable to maximize (make as high as possible) a cooling rate during casting by performing cooling from a melting temperature (about 700° C.) to a solidus temperature at a rate of 30° C./minute or more.

If such temperature (cooling rate) control in a high temperature region during casting is not performed, the cooling rate in this high temperature region inevitably decreases. When the cooling rate in the high temperature region has thus decreased, an amount of a intermetallic compound coarsely produced in the temperature range of the high temperature region increases to increase variations in the size and amount of the intermetallic compound in the sheet width direction of the ingot. This causes excessive non-uniformity in rolling strain which is introduced during hot rolling and cold rolling to result in large variations in crystal orientation after the solution/quenching treatment. As a result, the possibility is high that it becomes impossible to effect control for uniformizing the crystal orientation distribution state in the sheet width direction defined by the rectangular regions within the regulated range of the present invention for an improved ridging mark property.

(Homogenizing Heat Treatment)

Then, prior to hot rolling, the homogenizing heat treatment is performed to the cast aluminum alloy ingot mentioned above. The homogenizing heat treatment (soaking) aims at homogenizing a structure, i.e., eliminating segregation ingrains in the structure of the ingot. Therefore, as normally practiced, the temperature of the homogenizing heat treatment is appropriately selected from within the range of not less than 500° C. and less than a melting point, and a homogenizing period is appropriately selected from within the range of not less than four hours. If the homogenizing temperature is low, segregation in the grains cannot be sufficiently eliminated, and acts as a fracture origin so that stretch-flangeability and bendability deteriorate.

After the homogenizing heat treatment, hot rolling may be performed immediately. However, in the case where hot rolling is started at a desired hot-rolling starting temperature described later, cooling is performed from the homogenizing heat treatment temperature to the hot-rolling starting temperature, and then hot rolling is started. In this case, when hot rolling is started, the ingot is preferably held at the hot-rolling starting temperature for two hours or longer such that the structure thereof is in a more uniform state. More preferably, the ingot is temporarily cooled to room temperature after the homogenizing heat treatment, reheated to the hot-rolling starting temperature, and held at the reheating temperature for two hours or longer before hot rolling is started.

Depending on the thickness of a sheet to be rolled, hot rolling includes a rough rolling step for the ingot (slab) and a finish rolling step of rolling a sheet having a thickness of about 40 mm or less after rough rolling to a sheet thickness of about 4 mm or less. In these rough rolling step and finish rolling step, a rolling mill of a reverse type, a tandem type, or the like is used appropriately.

Here, particularly in hot rolling including the step of rough-rolling the ingot and the step of finish-rolling the sheet after subjected to rough rolling under the sheet thickness conditions shown above, the relationship between a rough-rolling starting temperature (hot-rolling starting temperature) Ts and a finish-rolling ending temperature (hot-rolling ending temperature) Tf is particularly important in effecting control for uniformizing the crystal orientation distribution state within the regulated range of the present invention.

That is, to manufacture the 6000-series aluminum alloy sheet having the uniform crystal orientation distribution described above, it is important to manufacture the 6000-series aluminum alloy sheet by particularly controlling the hot rolling conditions to control the structure of a rolled sheet after subjected to the hot rolling which causes the production of ridging marks. If coarse recrystallized grains are produced in the vicinity of a location corresponding to ¼ of the sheet thickness from the sheet surface during the hot rolling or after the hot rolling is ended, excessive integration of Cube orientation develops in the vicinity of the location corresponding to ¼ of the sheet thickness from the sheet surface where the coarse recrystallized grains mentioned above are produced after the subsequent cold rolling and solution treatment. As a result, the distribution states of Cube orientation, S orientation, and Cu orientation are likely to be biased. If a worked structure remains or a partially recrystallized structure is produced in the vicinity of a location corresponding to ½ of the sheet thickness after the hot rolling is ended, excessive integration of Goss orientation develops in the vicinity of the location corresponding to ½ of the sheet thickness from the sheet surface after the subsequent cold rolling and solution treatment. As a result, the distribution states of Cube orientation and Goss orientation are likely to be biased. Therefore, it becomes difficult to effect control for uniformizing the crystal orientation distribution states within the regulated range of the present invention.

Thus, to obtain a desired structure after the hot rolling which is for effecting control for uniformizing the crystal orientation distribution states within the regulated range of the present invention, the rough-rolling starting temperature (hot-rolling starting temperature) Ts and the finish-rolling ending temperature (hot-rolling ending temperature) Tf are determined to satisfy the following relational expression.

Relational Expression: $0.08 \times Ts + 320 \geqq Tf \geqq 0.25Ts + 190$

Here, if the finish-rolling ending temperature Tf (° C.) exceeds 0.08×Ts+320 shown above with respect to the rough-rolling starting temperature Ts (° C.), coarse recrystallized grains are likely to be produced in the vicinity of the location corresponding to ¼ of the sheet thickness from the sheet surface after the hot rolling is ended. In this case, excessive integration of Cube orientation develops in the vicinity of the location corresponding to ¼ of the sheet thickness from the sheet surface where the coarse recrystallized grains mentioned above are produced after the subsequent cold rolling and solution treatment. As a result, the distribution states of Cube orientation, S orientation, and Cu orientation are likely to be biased. On the other hand, if the finish-rolling ending temperature Tf (° C.) is less than 0.25Ts+190 with respect to the rough-rolling starting temperature Ts (° C.), a worked structure remains or a partially recrystallized structure is likely to be produced in the vicinity of the location corresponding to ½ of the sheet thickness after the hot rolling is ended. In this case, excessive integration of Goss orientation develops in the vicinity of the location corresponding to ½ of the sheet thickness from the sheet surface after the subsequent cold rolling and solution treatment. As a result, the distribution states of Cube orientation and Goss orientation are likely to be biased. Therefore, in either of the cases, it becomes difficult to effect control for uniformizing the crystal orientation distribution states within the regulated range of the present invention.

The rough-rolling starting temperature Ts (° C.) is selected in terms of the component composition and the thickness of the ingot, and is not necessarily specified. However, if the rough-rolling starting temperature Ts (° C.) exceeds 580° C., local melting of the ingot is likely to occur and, if the rough-rolling starting temperature Ts (° C.) is less than 340° C., a rolling force becomes excessively large so that rolling becomes difficult. If the rough-rolling starting temperature Ts (° C.) is higher than 450° C., depending on the amount of rolling strain accumulated during the hot rolling, coarse recrystallized grains may be produced in the vicinity of the location corresponding to ¼ of the sheet thickness from the sheet surface. Therefore, the rough-rolling starting temperature (hot rolling starting temperature) Ts is set in a range of 340 to 580° C., or more preferably 340 to 450° C.

(Final Pass Rolling Reduction)

The structure after the hot rolling is influenced not only by the control of the starting temperature and the ending temperature described above, but also by a rolling reduction and a rolling rate particularly in the finish rolling. The rolling reduction and the rolling rate in the finish rolling depend on the specifications of the rolling mill with which the hot rolling is performed, and therefore cannot be definitely determined. However, according to the result of testing and checking conducted by the present inventors, the final pass of the finish rolling is most influential. In terms of this, to obtain a desired structure after the hot rolling and effect control for uniformizing the crystal orientation distribution states within the regulated range of the present invention, it is desirable to satisfy the conditions for the rough-rolling starting temperature Ts shown above as well as the relationship between the rough-rolling starting temperature Ts and the finish-rolling ending temperature Tf, and then set the rolling reduction to 35% or more in the final pass of the finish rolling.

(Annealing of Hot-Rolled Sheet)

The annealing (pre-annealing) prior to the cold rolling of the hot-rolled sheet is not necessarily needed, but may also be performed for variation reduction such as the inhibition of the production of ridging marks by eliminating the influence of coarse recrystallized grains during the hot rolling which may be produced depending on the rough-rolling starting temperature Ts and strain during the hot rolling.

(Cold Rolling)

In the cold rolling, the hot-rolled sheet mentioned above is formed into a cold-rolled sheet (also including a coil) with a desired final thickness. Note that, to obtain finer grains, a cold rolling reduction is preferably 60% or more. For the same purpose, intermediate annealing may also be performed between cold rolling passes.

(Solution/Quenching treatment)

After the cold rolling, solution/quenching treatment is performed. Preferably, the solution treatment is performed under conditions such that the sheet is held at a temperature of 500° C. to 570° C. for 0 to 10 seconds, and then subjected to quenching treatment at a cooling rate of 10° C./second or higher. In the quenching treatment after the solution treatment, if the cooling rate is low, Si, Mg Si, or the like is likely to be precipitated on grain boundaries and serve as a crack origin during press forming or bending so that formability deteriorates. To ensure the cooling rate, the quenching treatment is preferably performed through selective use of air cooling using a fan or the like, a water cooling means such as mist, spraying, or immersion, and conditions to effect rapid cooling at a cooling rate of 10° C./second or higher.

To further enhance age hardenability in artificial age hardening treatment such as the paint baking step for a formed panel, preparatory aging treatment may also be performed immediately after the solution/quenching treatment. In the preparatory aging treatment, the sheet is preferably held in a temperature range of 70 to 140° C. for required hours in the range of 1 to 24 hours. The preparatory aging treatment is performed by reheating the sheet immediately after the cooling ending temperature in the quenching treatment described above is increased to 70 to 140° C. or holding the sheet at the increased temperature. Alternatively, the preparatory aging treatment is performed after the quenching treatment which is performed after the solution treatment till room temperature is reached by immediately reheating the sheet to 70 to 140° C. within ten minutes.

Further, to suppress room-temperature aging, heat treatment (artificial aging treatment) at a relatively low temperature may also be performed after the preparatory aging treatment described above without a temporal delay.

In the case of continuous solution/quenching treatment, the heat treatment is performed by, e.g., ending the quenching treatment within the temperature range of the preparatory aging described above, and rolling up the sheet into a coil at the high temperature. The sheet may be reheated before being rolled up into the coil, or held at the retained temperature after being rolled up. Alternatively, after the quenching treatment is performed till room temperature is reached, the sheet may also be, e.g., reheated to the temperature range shown above, and rolled up at the high temperature.

It will be appreciated that, besides, aging treatment at a higher temperature or stabilizing treatment may further be performed depending on the application and required properties to achieve a higher strength or the like.

The present invention will be described below more specifically by way of examples. However, the following examples are not intended to limit the present invention and may also be implemented by making appropriate modifications within the scope conformable to the gist described above and below, and these modifications are all included in the technical scope of the present invention.

Examples

Next, the examples of the present invention will be described. The 6000-series aluminum alloy sheets shown in Table 1 were each manufactured by performing homogenizing heat treatment (briefly referred to as soaking treatment) and hot rolling treatment (briefly referred to as hot rolling) under the conditions shown in Table 2, and further performing cold rolling and solution/quenching treatment. In the content of each of the elements shown in Table 1, the mark "—" indicates a value of not more than the detection limit.

More specific manufacturing conditions for the aluminum alloy sheets are as follows. The ingots of the individual compositions shown in Table 1 were each produced by melting and casting by a DC casting method. At this time, in each of the examples, the rate of cooling from a melting temperature (about 700° C.) to a solidus temperature during casting was set to 50° C./minute to effect control for uniformizing the crystal orientation distribution states within the regulated range of the present invention.

Subsequently, in each of the examples, the soaking treatment for the ingot was performed for five hours at the temperatures shown in Table 2. At this time, the ingots of the brevity codes 4, 5, 13, and 14 were not cooled after the homogenizing heat treatment, and the hot rolling (rough rolling) thereof was started at the temperatures Ts (° C.) which were the temperatures in the homogenizing heat treatment. In the other examples, the ingots were each temporarily cooled from the respective homogenizing heat treatment temperatures to room temperature, reheated to the hot-rolling starting temperatures Ts (° C.) after the cooling, and held at the temperatures for two hours before the hot rolling (rough rolling) was started. With finish rolling, the hot rolling was ended at the individual finish-rolling ending temperatures Tf (° C.) shown in Table 2 and, in each of the examples, the ingot was hot-rolled to a thickness of 3.5 mm into a hot-rolled sheet (coil). It is also shown in Table 2 whether or not the relational expression between the hot-rolling starting temperature Ts and the finish-rolling ending temperature Tf was satisfied in each of the examples. Rolling reductions in the final passes of the finish rolling are also shown in Table 2.

The aluminum alloy sheets of the brevity codes 2 and 8 of Table 2 after subjected to the hot rolling were subjected to intermediate annealing (process annealing) at 400° C. for three hours and to cold rolling. In the other examples, each of the aluminum alloy sheets was subjected to cold rolling without being subjected to process annealing, and rolled into a cold-rolled sheet (coil) with a thickness of 1.0 mm without being subjected to intermediate annealing between cold rolling passes. In each of the examples, the cold-rolled sheet was further subjected to solution/quenching treatment in which the cold-rolled sheet was heated to 550° C. in continuous heat treatment equipment, and immediately cooled to room temperature at an average cooling rate of 50° C./second. In each of the examples, the cold-rolled sheet was also subjected to preparatory aging treatment in which the cold-rolled sheet was reheated to 100° C. immediately after the cooling to room temperature, and held at the temperature for two hours.

Out of the individual final product sheets after subjected to these refining treatments, test sheets (blanks) were cut, and the structure and properties of each of the test sheets after 15-day room temperature aging (standing at room temperature) after the refining treatments described above were measured and evaluated.

(Textures of Test Sheets)

For the textures of the test sheets mentioned above, the area ratios of the individual crystal orientations at the predetermined depth locations described above and in the predetermined measurement rectangular regions described above were measured and analyzed using the SEM-EBSP mentioned above. The analysis/measurement results are shown in Table 3.

(Properties of Test Sheets)

Further, as the properties of the test sheets described above, a ridging mark property, 0.2% proof stress (As proof stress: MPa), and elongation (%) were each measured. The measurement results are also shown in Table 3.

(Ridging Marks)

To each of specimens cut out of the test sheets mentioned above, by simulating press forming under the strict conditions shown above, a 15% plastic strain was applied in each of directions at 90° and 45° to a rolling direction. Thereafter, ED painting was performed, and the test piece was visually inspected for the presence or absence of ridging marks. In the riding mark evaluation, the specimens in which ridging marks were not produced are each denoted by the mark "○", the specimens in which the production of ridging marks was slightly observed are each denoted by the mark "Δ", and the specimens in which the production of ridging marks was remarkably observed are each denoted by the mark "×".

(Mechanical Properties)

As a tensile test for measuring mechanical properties, No. 5 specimens (of a size of 25 mm×50 mm as GL×Thickness) according to JIS Z 2201 were collected from the test sheets, and subjected to a room temperature tensile test. At this time, the specimens were each stretched in a direction perpendicular to a rolling direction. A stretching rate was 5 mm/minute till 0.2% proof stress was reached, and set to 20 mm/minute after the proof stress was reached. The number of times N each of the mechanical properties was measured was set to 5, and an average value was calculated for each of the properties.

As shown in Tables 1 to 3, in each of the examples of the invention, hot rolling was performed within the component composition range of the present invention and under the condition that the relationship between the finish-rolling ending temperature Tf (° C.) and the rough-rolling starting temperature Ts (° C.) was in a preferable range. Accordingly, as shown in Table 3, each of the sheets according to Examples of the invention had the texture regulated in the present invention. That is, to inhibit the production of ridging marks, the crystal orientation distribution states in the relatively wide region of the sheet could be controlled to be uniform within the regulated range of the present invention. As a result, the production of ridging marks could be inhibited in the aluminum alloy sheet in the crystal orientation distribution state according to the present invention.

However, in each of Examples 6 and 7 in which hot rolling was performed by reducing the rolling reduction in the final pass of the finish rolling to 30%, a relatively coarse recrystallized structure was more likely to develop in the vicinity of the location corresponding to ¼ of the sheet thickness from the sheet surface after the hot rolling was ended than in the other Examples of the invention in each of which the rolling reduction was 35% or more and desirable. Consequently, the integration of Cube orientation developed in the vicinity of the location corresponding to ¼ of the sheet thickness from the surface of the product sheet, and the distribution states of Cube orientation, S orientation, and Cu orientation were relatively biased. As a result, in each of Examples 6 and 7 of the invention, the production of ridging marks particularly in a direction at 45° could not be inhibited completely in contrast the production of ridging marks in each of the other Examples of the invention which could be completely inhibited in each of directions at 90° and 45° to the rolling direction.

By contrast, in each of Comparative Examples 13 to 16, the same example of the alloy as that of Example 1 of the invention shown above was used, but hot rolling conditions were out of the preferable range, as shown in Table 2. In each of Comparative Examples 13 and 15, the finish-rolling ending temperature Tf (° C.) was less than 0.25Ts+190 shown above with respect to the rough-rolling starting temperature Ts (° C.). Consequently, in each of Comparative Examples 13 and 15, a worked structure remained in the vicinity of the location corresponding to ½ of the sheet thickness after the hot rolling was ended, excessive integration of Goss orientation occurred in the vicinity of the location corresponding to ½ of the sheet thickness from the surface of the product sheet, and the distribution states of Cube orientation and Goss orientation were biased. As a result, as shown in Table 3, the crystal orientation distribution states could not be controlled to be uniform within the regulated range of the present invention, and the ridging mark property was inferior to that in Example 1 of the invention.

In each of Comparative Examples 14 and 16, the finish-rolling ending temperature Tf (° C.) exceeded 0.08×Ts+320 shown above with respect to the rough-rolling starting temperature Ts (° C.). Accordingly, in each of Comparative Examples 14 and 16, a coarse recrystallized structure developed particularly in the vicinity of the location corresponding to ¼ of the sheet thickness from the sheet surface after hot rolling was ended, excessive integration of Cube orientation occurred in the vicinity of the location corresponding to ¼ of the sheet thickness from the surface of the product sheet, and the distribution states of Cube orientation, S orientation, and Cu orientation were biased. As a result, as shown in Table 3, the crystal orientation distribution states could not be controlled to be uniform within the regulated range of the present invention, and the ridging mark property was inferior to that in Example 1 of the invention.

In each of Comparative Examples 10 to 12, hot rolling was performed in a preferable range, but the component composition was out of the range of the present invention. Accordingly, in terms of the component composition also, the riding mark property is significantly inferior to that in each of Examples of the invention or, even when the riding mark property was satisfactory, the strength and the elongation were significantly inferior to those in each of Examples of the invention.

Therefore, the foregoing results of the examples endorse each of requirements placed on components and structures in the present invention or the critical significance or effect of preferable manufacturing conditions for simultaneously obtaining the ridging mark property, the mechanical properties, and the like.

TABLE 1

| | | Chemical components of Al alloy sheet (mass %) | | | | | | | |
|---|---|---|---|---|---|---|---|---|---|
| Category | No. | Si | Fe | Cu | Mn | Mg | Cr | Zn | Ti |
| Examples of Invention | 1 | 1.0 | 0.20 | — | 0.05 | 0.5 | — | — | 0.01 |
| | 2 | 1.3 | 0.20 | — | — | 0.5 | 0.05 | — | 0.01 |
| | 3 | 1.0 | 0.20 | 0.70 | 0.05 | 0.6 | — | — | 0.01 |
| | 4 | 0.6 | 0.20 | — | 0.05 | 0.6 | — | 0.05 | 0.01 |
| Comparative Examples | 5 | 1.6 | 0.20 | — | 0.05 | 0.5 | — | — | 0.01 |
| | 6 | 1.0 | 0.20 | — | 0.05 | 1.5 | — | — | 0.01 |
| | 7 | 0.3 | 0.20 | — | 0.05 | 0.8 | — | — | 0.01 |

TABLE 2

| | | | | Hot Rolling | | | | | |
|---|---|---|---|---|---|---|---|---|---|
| | Brevity | Alloy | Homogenizing Heat Treatment | Starting Temperature TS | Ending Temperature TF | Final Pass Rolling Reduction | Intermediate | Remarks | |
| Category | Code | No. | ° C. | ° C. | ° C. | % | Annealing | 0.08 × TS + 320 | 0.25 × TS + 190 |
| Examples of Invention | 1 | 1 | 540 | 400 | 305 | 45 | Not performed | 352 | 290 |
| | 2 | 2 | 540 | 400 | 320 | 45 | Performed | 352 | 290 |
| | 3 | 3 | 560 | 400 | 325 | 45 | Not performed | 352 | 290 |
| | 4 | 4 | 560 | 560 | 340 | 45 | Not performed | 365 | 330 |
| | 5 | 1 | 560 | 560 | 350 | 45 | Not performed | 365 | 330 |
| | 6 | 1 | 560 | 450 | 350 | 30 | Not performed | 356 | 303 |
| | 7 | 3 | 540 | 400 | 345 | 30 | Not performed | 352 | 290 |
| | 8 | 1 | 540 | 400 | 295 | 45 | Performed | 352 | 290 |
| | 9 | 1 | 540 | 350 | 290 | 45 | Not performed | 348 | 278 |
| Comparative Examples | 10 | 5 | 540 | 400 | 300 | 45 | Not performed | 352 | 290 |
| | 11 | 6 | 540 | 400 | 300 | 30 | Not performed | 352 | 290 |
| | 12 | 7 | 540 | 400 | 300 | 45 | Not performed | 352 | 290 |
| | 13 | 1 | 540 | 540 | 310 | 45 | Not performed | 363 | 325 |
| | 14 | 1 | 540 | 540 | 370 | 45 | Not performed | 363 | 325 |
| | 15 | 1 | 540 | 400 | 280 | 30 | Not performed | 352 | 290 |
| | 16 | 1 | 540 | 400 | 360 | 45 | Not performed | 352 | 290 |

TABLE 3

| Category | Brevity Code | Sheet surface $W_{min}$ % | Sheet surface $W_{max}$ % | Sheet surface $W_{max}-W_{min}$ % | Sheet surface $A_{max}-A_{min}$ % | Plane at depth corresponding to ¼ of sheet thickness $W_{min}$ % | Plane at depth corresponding to ¼ of sheet thickness $A_{max}-A_{min}$ % | Plane at depth corresponding to ½ of sheet thickness $W_{min}$ % | Plane at depth corresponding to ½ of sheet thickness $G_{max}$ % | Plane at depth corresponding to ½ of sheet thickness $B_{max}-B_{min}$ % | Ridging mark evaluation: Direction at 90 degrees | Ridging mark evaluation: Direction at 45 degrees | Mechanical Properties: Tensile strength MPa | Mechanical Properties: Proof stress Mpa | Mechanical Properties: Elongation % |
|---|---|---|---|---|---|---|---|---|---|---|---|---|---|---|---|
| Examples of Invention | 1 | 2.2 | 5.7 | 3.5 | 4.8 | 2.4 | 4.5 | 2.2 | 1.2 | 6.0 | ○ | ○ | 232 | 125 | 27 |
| | 2 | 2.7 | 8.1 | 5.4 | 6.3 | 3.0 | 5.8 | 2.5 | 1.7 | 4.1 | ○ | ○ | 240 | 131 | 29 |
| | 3 | 3.3 | 8.5 | 5.2 | 6.0 | 3.0 | 6.6 | 3.6 | 1.1 | 5.6 | ○ | ○ | 257 | 133 | 29 |
| | 4 | 5.0 | 10.8 | 5.8 | 6.8 | 6.2 | 7.5 | 7.0 | 0.9 | 4.9 | ○ | ○ | 218 | 120 | 26 |
| | 5 | 5.2 | 11.2 | 6.0 | 7.2 | 5.8 | 7.8 | 6.1 | 0.8 | 4.0 | ○ | ○ | 241 | 134 | 28 |
| | 6 | 2.9 | 10.5 | 7.6 | 8.5 | 2.3 | 9.2 | 2.3 | 1.0 | 5.3 | ○ | Δ | 230 | 123 | 27 |
| | 7 | 4.2 | 12.4 | 8.2 | 9.0 | 3.3 | 8.8 | 3.0 | 0.8 | 4.8 | ○ | Δ | 256 | 131 | 29 |
| | 8 | 2.3 | 8.6 | 6.3 | 7.0 | 2.9 | 8.3 | 3.0 | 3.0 | 7.1 | ○ | ○ | 230 | 124 | 27 |
| | 9 | 3.3 | 10.3 | 7.0 | 7.8 | 3.5 | 9.5 | 2.4 | 4.5 | 8.3 | Δ | ○ | 235 | 127 | 27 |
| Comparative Examples | 10 | 5.8 | 14.0 | 8.2 | 9.8 | 3.9 | 10.5 | 4.4 | 1.3 | 5.1 | Δ | Δ | 240 | 129 | 22 |
| | 11 | 11.2 | 23.0 | 11.8 | 13.8 | 6.5 | 12.2 | 5.5 | 1.3 | 6.4 | x | x | 242 | 128 | 29 |
| | 12 | 7.6 | 17.1 | 9.5 | 8.1 | 5.0 | 9.6 | 4.5 | 0.9 | 6.8 | Δ | Δ | 165 | 91 | 24 |
| | 13 | 1.8 | 11.9 | 10.1 | 9.4 | 1.9 | 10.5 | 1.5 | 12.0 | 14.2 | x | x | 242 | 134 | 29 |
| | 14 | 11.0 | 24.0 | 13.0 | 16.2 | 11.3 | 15.3 | 9.7 | 1.1 | 10.3 | x | x | 242 | 133 | 29 |
| | 15 | 7.5 | 17.7 | 10.2 | 11.7 | 2.8 | 11.9 | 1.8 | 7.1 | 12.4 | x | x | 235 | 125 | 27 |
| | 16 | 7.6 | 18.0 | 10.4 | 12.3 | 4.0 | 13.1 | 5.1 | 0.8 | 8.9 | x | x | 230 | 122 | 27 |

The invention claimed is:

1. An Al—Mg—Si aluminum alloy sheet comprising, in mass %:

Mg: 0.4 to 1.0%;

Si: 0.4 to 1.5%;

Mn: 0.01 to 0.5%;

Cu: 0.001% to 1.0%; and a remainder comprising Al and inevitable impurities, wherein, when an average area ratio of Cube orientation, which is a texture in a surface of the alloy sheet, in a rectangular region of 500 μm in an arbitrary widthwise rolling direction×2000 μm in an arbitrary lengthwise rolling direction is W, with respective Cube orientation average area ratios in ten rectangular regions each having the same area successively adjacent to each other in the widthwise rolling direction in the rectangular region are W1 to W10, a minimum Cube orientation average area ratio among Cube orientation average area ratios W1 to W10 is Wmin, and a maximum Cube orientation average area ratio among the Cube orientation average area ratios W1 to W10 is Wmax, the minimum Cube orientation average area ratio, Wmin, is set to 2% or more, and a difference, Wmax−Wmin, between the maximum Cube orientation average area ratio, Wmax, and the minimum Cube orientation average area ratio, Wmin, is set to 10% or less.

2. An aluminum alloy sheet according to claim 1, wherein the maximum Cube orientation average area ratio Wmax among the Cube orientation average area ratios W1 to W10 in the surface of the aluminum alloy sheet, in a portion of the aluminum alloy sheet at a depth corresponding to ¼ of sheet thickness from a surface of the aluminum alloy sheet, or in a portion of the aluminum alloy sheet at a depth corresponding to ½ of sheet thickness from a surface of the aluminum alloy sheet is set to 20% or less.

3. An Al—Mg—Si aluminum alloy sheet comprising, in mass %:

Mg: 0.4 to 1.0%;

Si: 0.4 to 1.5%;

Mn: 0.01 to 0.5;

Cu: 0.001% to 1.0%; and a remainder comprising Al and inevitable impurities, wherein, when respective average area ratios of Cube orientation, S orientation, and Cu orientation, each of which is a texture in a surface of the alloy sheet, in a rectangular region of 500 μm in an arbitrary widthwise rolling direction×2000 μm in an arbitrary lengthwise rolling direction are W, S, and C, respective Cube orientation average area ratios, respective S orientation average area ratios, and respective Cu orientation average area ratios in ten rectangular regions each having the same area and successively adjacent to each other in the widthwise rolling direction in the rectangular region when a difference A among respective average area ratios of individual orientations is determined from an expression W—S—C are W1 to W10, S1 to S10, and C1 to C10, respectively, and respective differences among the respective average area ratios of the individual orientations each determined from the expression are A1 to A10, the minimum Cube orientation average area ratio among the Cube orientation average area ratios W1 to W10 is set to 2% or more, and a difference, Amax−Amin, between a maximum average area ratio difference, Amax, and a minimum average area ratio difference, Amin, among the respective differences A1 to A10 among the respective average area ratios of the individual orientations is set to 10% or less.

4. An aluminum alloy sheet according to claim 3, wherein the maximum Cube orientation average area ratio Wmax among the Cube orientation average area ratios W1 to W10 in the surface of the aluminum alloy sheet, in a portion of the aluminum alloy sheet at a depth corresponding to ¼ of sheet thickness from a surface of the aluminum alloy sheet, or in a portion of the aluminum alloy sheet at a depth corresponding to ½ of sheet thickness from a surface of the aluminum alloy sheet is set to 20% or less.

5. An Al—Mg—Si aluminum alloy sheet comprising, in mass %:

Mg: 0.4 to 1.0%;

Si: 0.4 to 1.5%;

Mn: 0.01 to 0.5%;

Cu: 0.001% to 1.0%; and a remainder comprising Al and inevitable impurities, wherein, when respective average area ratios of Cube orientation, S orientation, and Cu orientation, each of which is a texture in a portion of the alloy sheet at a depth corresponding to ¼ of a sheet thickness from a surface of the alloy sheet, in a rectangular region of 500 μm in an arbitrary widthwise rolling direction×2000 μm in an arbitrary lengthwise rolling direction are W, S, and C, respective Cube orientation average area ratios, respective S orientation average area ratios, and respective Cu orientation average area ratios in ten rectangular regions each having the same area and successively adjacent to each other in the widthwise rolling direction in the rectangular region when a difference A among respective average area ratios of individual orientations is determined from an expression W—S—C are W1 to W10, S1 to S10, and C1 to C10, respectively, and respective differences among the respective average area ratios of the individual orientations each determined from the expression are A1 to A10, the minimum Cube orientation average area ratio among the Cube orientation average area ratios W1 to W10 is set to 2% or more, and a difference, Amax−Amin, between a maximum average area ratio difference, Amax, and a minimum average area ratio difference, Amin, among the respective differences A1 to A10 among the respective average area ratios of the individual orientations is set to 10% or less.

6. An aluminum alloy sheet according to claim 5, wherein the maximum Cube orientation average area ratio Wmax among the Cube orientation average area ratios W1 to W10 in the surface of the aluminum alloy sheet, in a portion of the aluminum alloy sheet at a depth corresponding to ¼ of sheet thickness from a surface of the aluminum alloy sheet, or in a portion of the aluminum alloy sheet at a depth corresponding to ½ of sheet thickness from a surface of the aluminum alloy sheet is set to 20% or less.

7. An Al—Mg—Si aluminum alloy sheet comprising, in mass %:

Mg: 0.4 to 1.0%;

Si: 0.4 to 1.5%;

Mn: 0.01 to 0.5%;

Cu: 0.001% to 1.0%; and a remainder comprising Al and inevitable impurities, wherein, when respective average area ratios of Cube orientation and Goss orientation, each of which is a texture in a portion of the alloy sheet at a depth corresponding to ½ of a sheet thickness from a surface of the alloy sheet, in a rectangular region of 500 μm in an arbitrary widthwise rolling direction×2000 μm in an arbitrary lengthwise rolling direction are W and G, respective Cube orientation average area ratios and respective Goss orientation average area ratios in ten rectangular regions each having the same area and successively adjacent to each other in the widthwise rolling direction in the rectangular region when a difference B between respective average area ratios of individual orientations is determined from an expression W-G are W1 to W10 and G1 to G10, respectively, and respective differences between the respective average area ratios of the individual orientations each determined from the expression are B1 to B10, a minimum Cube orientation average area ratio among Cube orientation average area ratios W1 to W10 is set to 2% or more, and a difference, Bmax−Bmin, between a maximum average area ratio difference, Bmax, and a minimum average area ratio difference, Bmin, among the respective differences B1 to B10 between the respective average area ratios of the individual orientations is set to 10% or less.

8. An aluminum alloy sheet according to claim 7, wherein the maximum Cube orientation average area ratio Wmax among the Cube orientation average area ratios W1 to W10 in the surface of the aluminum alloy sheet, in a portion of the aluminum alloy sheet at a depth corresponding to ¼ of sheet thickness from a surface of the aluminum alloy sheet, or in a portion of the aluminum alloy sheet at a depth corresponding to ½ of sheet thickness from a surface of the aluminum alloy sheet is set to 20% or less.

9. An aluminum alloy sheet according to claim 7, wherein a maximum Goss orientation average area ratio Gmax among Goss orientation average area ratios G1 to G10 in a portion of the aluminum alloy sheet at a depth corresponding to ½ of sheet thickness from a surface of the aluminum alloy sheet is set to 10% or less.

10. An aluminum alloy sheet according to claim 9, wherein the maximum Cube orientation average area ratio Wmax among the Cube orientation average area ratios W1 to W10 in the surface of the aluminum alloy sheet, in a portion of the aluminum alloy sheet at a depth corresponding to ¼ of sheet thickness from a surface of the aluminum alloy sheet, or in a portion of the aluminum alloy sheet at a depth corresponding to ½ of sheet thickness from a surface of the aluminum alloy sheet is set to 20% or less.

11. A method of manufacturing the aluminum alloy sheet according to claim 1, the method comprising:

subjecting an ingot of an Al—Mg—Si aluminum alloy comprising, in mass %:

Mg: 0.4 to 1.0%;

Si: 0.4 to 1.5%;

Mn: 0.01 to 0.5%;

Cu: 0.001% to 1.0%; and a remainder comprising Al and inevitable impurities, to homogenizing heat treatment, to yield a first intermediate;

then hot rolling the first intermediate at a hot rolling starting temperature Ts in a range of 340 to 580° C. to a hot-rolling ending temperature Tf° C. satisfying a relational expression: $0.08\times Ts+320 \geqq Tf \geqq 0.25Ts+190$ with respect to the hot-rolling starting temperature Ts, to yield a second intermediate; and cold rolling the second intermediate, to yield a third intermediate; and thereafter subjecting the third intermediate to solution/quenching treatment to provide a texture wherein, when an average area ratio of Cube orientation, which is the texture in a surface of the alloy sheet, in a rectangular region of 500 μm in an arbitrary widthwise rolling direction×2000 μm in an arbitrary lengthwise rolling direction is W, with respective Cube orientation average area ratios in ten rectangular regions each having the same area successively adjacent to each other in the widthwise rolling direction in the rectangular region are W1 to W10, a minimum Cube orientation average area ratio among Cube orientation average area ratios W1 to W10 is Wmin, and a maximum Cube orientation average area ratio among the Cube orientation average area ratios W1 to W10 is Wmax, the minimum Cube orientation average area ratio, Wmin, is set to 2% or more, and a difference, Wmax−Wmin, between the maximum Cube orientation average area ratio, Wmax, and the minimum Cube orientation average area ratio, Wmin, is set to 10% or less.

12. A method of manufacturing the aluminum alloy sheet according to claim 3, the method comprising:

subjecting an ingot of an Al—Mg—Si aluminum alloy comprising, in mass %:

Mg: 0.4 to 1.0%;

Si: 0.4 to 1.5%;

Mn: 0.01 to 0.5%;

Cu: 0.001% to 1.0%; and a remainder comprising Al and inevitable impurities, to homogenizing heat treatment, to yield a first intermediate; then hot rolling the first intermediate at a hot rolling starting temperature Ts in a range of 340 to 580° C. to a hot-rolling ending temperature Tf° C., satisfying a relational expression: $0.08\times Ts+320 \geqq Tf \geqq 0.25Ts+190$ with respect to the hot-rolling starting temperature Ts, to yield a second intermediate;

cold rolling the second intermediate to yield a third intermediate; and thereafter subjecting the third intermediate to solution/quenching treatment to provide textures wherein, when respective average area ratios of Cube orientation, S orientation, and Cu orientation, each of which is a texture in a surface of the alloy sheet, in a rectangular region of 500 μm in an arbitrary widthwise rolling direction× 2000 μm in an arbitrary rolling direction are W, S, and C, respective Cube orientation average area ratios, respective S orientation average area ratios, and respective Cu orientation average area ratios in ten rectangular regions each having the same area and successively adjacent to each other in the widthwise rolling direction in the rectangular region when a difference A among respective average area ratios of individual orientations is determined from an expression W—S—C are W1 to W10, S1 to S10, and C1 to C10, respectively, and respective differences among the respective average area ratios of the individual orientations each determined from the expression are A1 to A10, the minimum Cube orientation average area ratio among the Cube orientation average area ratios W1 to W10 is set to 2% or more, and a difference, Amax−Amin, between a maximum average area ratio difference, Amax, and a minimum average area ratio difference, Amin, among the respective differences A1 to A10 among the respective average area ratios of the individual orientations is set to 10% or less.

13. A method of manufacturing the aluminum alloy sheet according to claim 5, the method comprising:

subjecting an ingot of an Al—Mg—Si aluminum alloy comprising, in mass %:

Mg: 0.4 to 1.0%;

Si: 0.4 to 1.5%;

Mn: 0.01 to 0.5%;

Cu: 0.001% to 1.0%; and a remainder comprising Al and inevitable impurities, to homogenizing heat treatment, to yield a first intermediate; then hot rolling the first intermediate at a hot rolling starting temperature Ts in a range of 340 to 580° C. to a hot-rolling ending temperature Tf° C., satisfying a relational expression: $0.08\times Ts+320 \geqq Tf \geqq 0.25Ts+190$ with respect to the hot-rolling starting temperature Ts, to yield a second intermediate;

cold rolling the second intermediate to yield a third intermediate; and thereafter subjecting the third intermediate to solution/quenching treatment to provide textures wherein, when respective average area ratios of Cube orientation, S orientation, and Cu orientation, each of which is a texture in a portion of the alloy sheet at a depth corresponding to ¼ of a sheet thickness from a surface of the alloy sheet, in a rectangular region of 500 μm in an arbitrary widthwise rolling direction×2000 μm in an arbitrary lengthwise rolling direction are W, S, and C, respective Cube orientation average area ratios, respective S orientation average area ratios, and respective Cu orientation average area ratios in ten rectangular regions each having the same area and successively adjacent to each other in the widthwise rolling direction in the rectangular region when a difference A among respective average area ratios of individual orientations is determined from an expression W—S—C are W1 to W10, S1 to S10, and C1 to C10, respectively, and respective differences among the respective average area ratios of the individual orientations each determined from the expression are A1 to A10, the minimum Cube orientation average area ratio among the Cube orientation average area ratios W1 to W10 is set to 2% or more, and a difference, Amax−Amin, between a maximum average area ratio difference, Amax, and a minimum average area ratio difference, Amin, among the respective differences A1 to A10 among the respective average area ratios of the individual orientations is set to 10% or less.

14. A method of manufacturing the aluminum alloy sheet according to claim 7, the method comprising:

subjecting an ingot of an Al—Mg—Si aluminum alloy comprising, in mass %:

Mg: 0.4 to 1.0%;

Si: 0.4 to 1.5%;

Mn: 0.01 to 0.5%;

Cu: 0.001% to 1.0%; and a remainder comprising Al and inevitable impurities, to homogenizing heat treatment, to yield a first intermediate;

then hot rolling the first intermediate at a hot rolling starting temperature Ts in a range of 340 to 580° C. to a hot-rolling ending temperature Tf° C., satisfying a relational expression: $0.08\times Ts+320 \geqq Tf \geqq 0.25Ts+190$ with respect to the hot-rolling starting temperature Ts, to yield a second intermediate; then cold rolling the second intermediate to yield a third intermediate; and thereafter subjecting the third intermediate to solution/quenching treatment to provide textures wherein, when respective average area ratios of Cube orientation and Goss orientation, each of which is a texture in a portion of the alloy sheet at a depth corresponding to ½ of a sheet thickness from a surface of the alloy sheet, in a rectangular region of 500 μm in an arbitrary widthwise rolling direction×2000 μm in an arbitrary lengthwise rolling direction are W and G, respective Cube orientation average area ratios and respective Goss orientation average area ratios in ten rectangular regions each having the same area and successively adjacent to each other in the widthwise rolling direction in the rectangular region when a difference B between respective average area ratios of individual orientations is determined from an expression W-G are W1 to W10 and G1 to G10, respectively, and respective differences between the respective average area ratios of the individual orientations each determined from the expression are B1 to B10, a minimum Cube orientation average area ratio among Cube orientation average area ratios W1 to W10 is set to 2% or more, and a difference, Bmax−Bmin, between a maximum average area ratio difference, Bmax, and a minimum average area ratio difference, Bmin, among the respective differences B1 to B10 between the respective average area ratios of the individual orientations is set to 10% or less.

* * * * *